US006334254B1

(12) United States Patent
Wonderley

(10) Patent No.: US 6,334,254 B1
(45) Date of Patent: Jan. 1, 2002

(54) WIDE BLADE SCRAPER

(75) Inventor: Jeffrey W. Wonderley, Ft. Defiance, VA (US)

(73) Assignee: American Safety Razor, Verona, VA (US)

( * ) Notice: Subject to any disclaimer, the term of this patent is extended or adjusted under 35 U.S.C. 154(b) by 0 days.

(21) Appl. No.: 09/363,008

(22) Filed: Jul. 30, 1999

Related U.S. Application Data

(60) Provisional application No. 60/098,895, filed on Sep. 2, 1998, and provisional application No. 60/094,739, filed on Jul. 31, 1998.

(51) Int. Cl.[7] ..... B26B 5/00

(52) U.S. Cl. ..... 30/169; 30/125; 30/333

(58) Field of Search ..... 30/169, 125, 329, 30/332, 333, 337, 339, 151, 30, 31, 335, 124

(56) References Cited

U.S. PATENT DOCUMENTS

| | | | | |
|---|---|---|---|---|
| 1,726,017 A | * | 8/1929 | Des Enfants, Sr. | 30/151 |
| 2,766,471 A | * | 10/1956 | McKenzie | 30/151 |
| 3,855,700 A | | 12/1974 | Gerson et al. | 30/169 |
| 4,068,375 A | | 1/1978 | Rathbun et al. | 30/125 |
| 4,662,070 A | | 5/1987 | Reddig | 30/125 |
| 4,884,342 A | | 12/1989 | McNamara et al. | 30/162 |
| 4,955,138 A | | 9/1990 | Henke et al. | 30/169 |
| 5,025,558 A | | 6/1991 | Gilbert | 30/162 |
| 5,042,154 A | | 8/1991 | Gilbert | 30/162 |
| 5,319,853 A | | 6/1994 | Schmidt | 30/169 |
| 5,509,205 A | | 4/1996 | Ragland, III | 30/162 |
| 5,561,906 A | | 10/1996 | Desmarais | 30/339 |
| 5,797,188 A | | 8/1998 | Gilbert | 30/330 |
| 5,845,404 A | | 12/1998 | Jeffcoat | 30/125 |
| 5,906,050 A | | 5/1999 | Gilbert | 30/162 |
| 5,983,500 A | | 11/1999 | da Silva | 30/125 |
| 5,996,231 A | | 12/1999 | Roche et al. | 30/169 |

FOREIGN PATENT DOCUMENTS

| | | | |
|---|---|---|---|
| DE | 3203-415 A1 | 11/1983 | 30/169 |
| GB | 852659 | 10/1960 | 30/169 |
| GB | 1205961 | 9/1970 | 30/169 |

* cited by examiner

*Primary Examiner*—Hwei-Siu Payer
(74) *Attorney, Agent, or Firm*—McDermott, Will & Emery

(57) ABSTRACT

In order to ergonomically induce relative sliding between a base and a cover member wherein the base is slidably mounted on the base and wherein the two members go to make a wide blade scraper body, a cam bearing wheel is mounted on the base and arranged to operatively engage a cam following feature which is formed on the cover. Rotation of the cam wheel which projects out of the sides of the handle portion with the thumb or the like, induces the cover to move relative to the base. As the relative movement proceeds a wide blade which is mounted at the leading edge of the scraper is released from a clamped constantly exposed position and is rendered changeable.

16 Claims, 10 Drawing Sheets

WIDE BLADE SCRAPER

CROSS-REFERENCE TO RELATED APPLICATIONS

This application claims priority from Provisional Patent Application Serial No. 60/094,739 filed on Jul. 31, 1998, entitled WIDE BLADE SCRAPER and Provisional Patent Application Serial No. 60/098,895 filed on Sep. 2, 1998, entitled WIDE BLADE SCRAPER. The content of these Provisional Patent Applications is hereby incorporated by reference thereto.

BACKGROUND OF THE INVENTION

1. Field of the Invention

The present invention relates generally to scrapers such as those used for removing paint, adhesive labels or the like from surfaces such as glass or the like, and more specifically, to a wide blade type of scraper having cam driven relatively movable parts.

2. Description of the Relevant Art

Various attempts have been made to develop scraper arrangements which facilitate a quick and easy exposure of a blade for scraping purposes. One example of such an arrangement is found in U.S. Pat. No. 4,955,138 issued on Sep. 11, 1990 in the name of Henke et al.

However, while this arrangement has proven relatively effective, it has suffered from the drawbacks that it has not been adapted for use with a relatively wide scraping blade (e.g. blades having a width of 4"), and has a relatively complex, structure revealing configuration which tends to lack aesthetic qualities. Additionally, the operation of the trigger arrangement which controls the blade exposure is, due to its inherent nature, notchy in feel.

SUMMARY OF THE INVENTION

It is proposed, in accordance with the present invention, to provide a wide blade scraper that features a slidable housing arrangement wherein a cover is slidably mounted on a base and arranged to be driven between first and second operating positions by a manually operable member mounted on one of the base and the cover.

It is further proposed, in accordance with the present invention, to provide a wide blade scraper that features the use a rotatable cam bearing member which is supported on one of the two basic housing members (viz., the base and the cover) and which engages a cam follower feature on the other of the base and the cover, in a manner which produces reciprocal displacement between the two housing members.

It is additionally proposed to provide a wide blade scraper wherein the cam induced relative movement between the base and the cover, enables a blade to set in place and subsequently clamped in position.

In brief, in order to ergonomically induce relative sliding between a base and a cover member, wherein the base is slidably mounted on the base and wherein the two members go to make a wide blade scraper body, a cam wheel is mounted on the base and arranged to operatively engage a cam following feature which is formed on the cover. Rotation of the cam wheel, which projects out of the sides of a waisted section of the handle portion, with the thumb or the like, induces the cover to slide along the length of the base. As the relative movement proceeds, a wide blade which is mounted at the leading edge of the scraper is released from a clamped state and can be removed, changed or just reversed so that that a dull edge is exposed for safety.

More specifically a first aspect of the present invention resides in a scraper comprising: a lower body having a handle portion; an upper cover slidably supported on the body; a rotatable member operatively supported on one of the body and cover and which is arranged to interconnect the body and the cover in a manner wherein rotation of the rotatable member causes sliding displacement to occur between the body and the cover.

The above arrangement also is provided with an end cap which is disposed on the end of the handle portion and adapted to enclose an end portion of the cover. The reason for this provision is that the handle portion and the cover are arranged to define a space therebetween in which at least one blade which is mountable at the front of the scraper, can be stored, the cap being slidably mounted on the handle portion so as to be selectively removable from the hand portion in a manner which exposes the hollow portion and permits the removal or insertion of a blade thereinto.

In the above arrangement, the rotatable member is mounted on the body and is formed with a cam surface which operatively engages a cam follower structure formed on the inner surface of the cover. Alternatively, the rotatable member is mounted on the cover and is formed with a cam surface which operatively engages a cam follower structure formed on the inner surface of the body.

A second aspect of the invention resides in a cam operated tool comprising: first and second halves which are slidably mounted on one another; a cam follower structure formed on the first half; and a cam wheel having a cam surface rotatably mounted on the second half, the cam wheel having a portion which extends beyond the first and second halves so as to be manually manipulable and rotatable so as to enable selective rotation of the cam wheel in a manner which drives the first and second halves to slide relative to one another.

In accordance with this tool, male engagement features are formed on one of the first and second halves which engage in female engagement slots formed in the other of the first and second halves. The male features are arranged to slide along the female engagement slots in a manner which permits the one half to slide with respect to the other. Further, this tool is such that a handle which is defined by first and second end portions of the first and second halves, the first and second end portions cooperating to define a hollow handle portion which is capable of storing at least one tool element.

This tool further comprises a head portion which is connected with the handle portion and which is defined by first and second leading portions of the first and second halves; and a blade mounting portion defined by the first and second leading portions of the first and second halves, the first and second leading portions cooperating to define a blade mounting site. The head portion is wider than the handle portion and so dimensioned as to extend out on either side of the handle portion in a manner which forms an essentially T-shape, the first and second leading portions being adapted to support a blade between leading edges of the first and second leading portions.

BRIEF DESCRIPTION OF THE DRAWINGS

The various features and advantages of the present invention will become more clearly appreciated from the following detailed description of the preferred embodiment taken with the appended drawings in which.

DETAILED DESCRIPTION OF THE PREFERRED EMBODIMENTS

Figure 1:
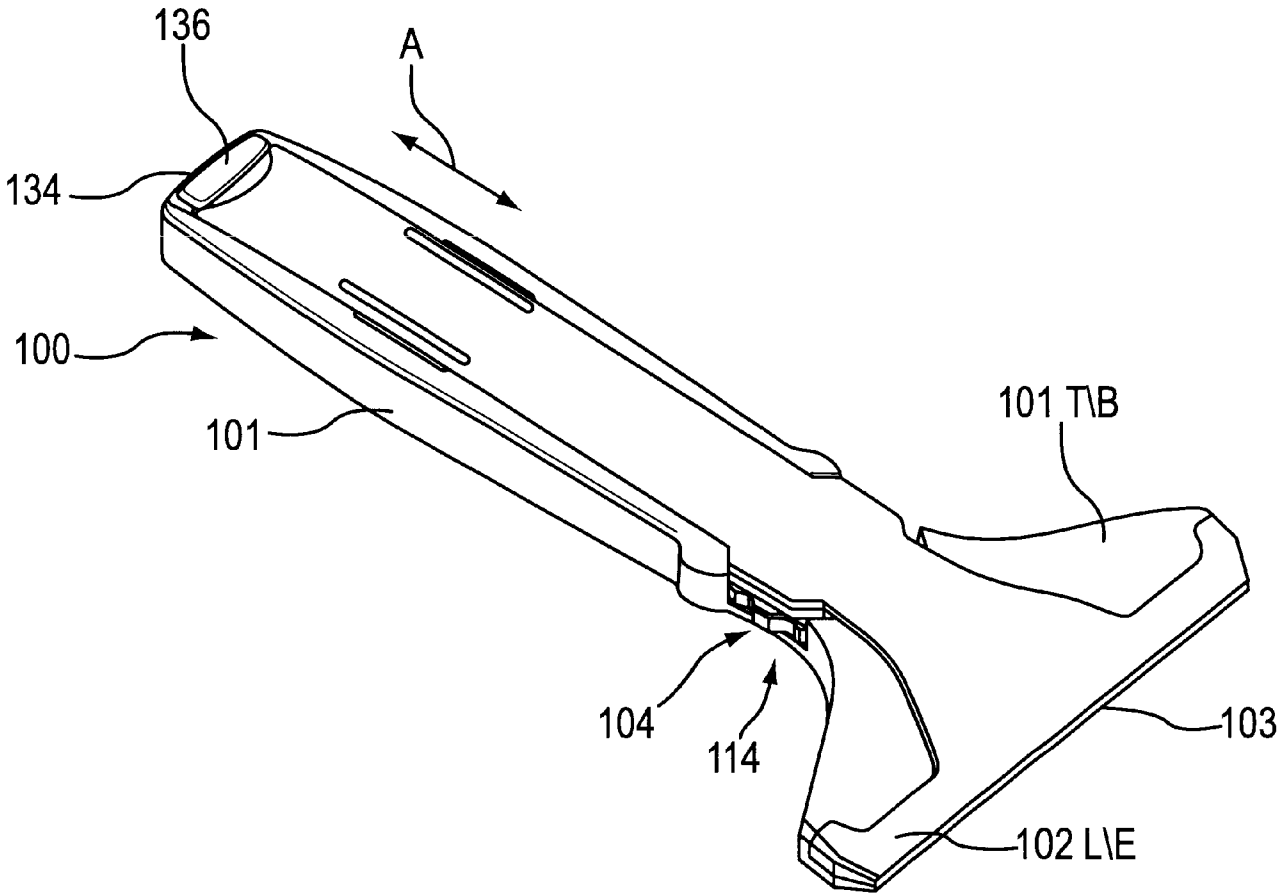
FIG. 1 is a perspective view showing an upper side of the wide blade scraper according to an embodiment of the present invention.

FIG. 1 shows, in perspective view, an embodiment of a wide blade scraper 100 according to the present invention. In this arrangement, a base 101 and a cover 102 are adapted in a manner which permits the cover 102 to be displaced relative to the base 101 in the direction indicated by the double-ended arrow A. A wide blade 103 which is disposed at the leading edge of the essentially T-bar shaped head portion of the scraper 100 is arranged to be exposed when the cover 102 is retracted in the manner illustrated in FIG. 1 and to be covered when the cover 102 is moved to its fully forward position.

Figure 2:
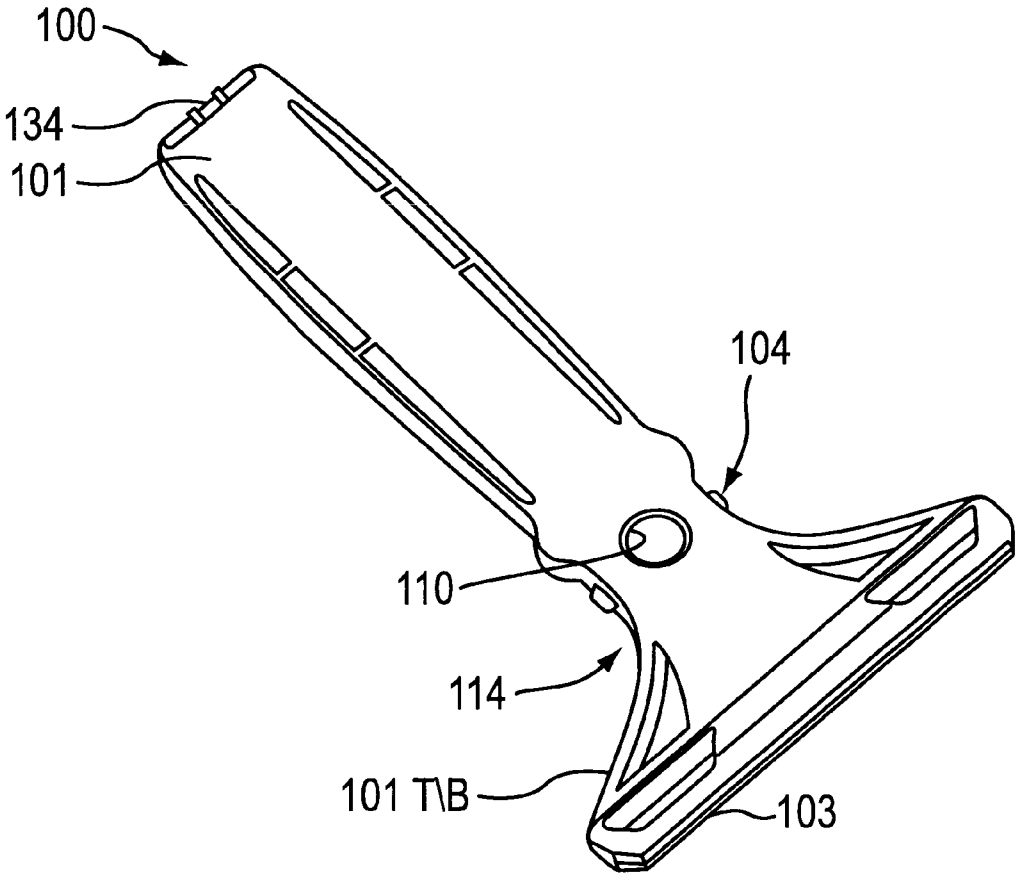
FIG. 2 is a perspective view showing a lower side of the embodiment of the invention.
Figure 3:
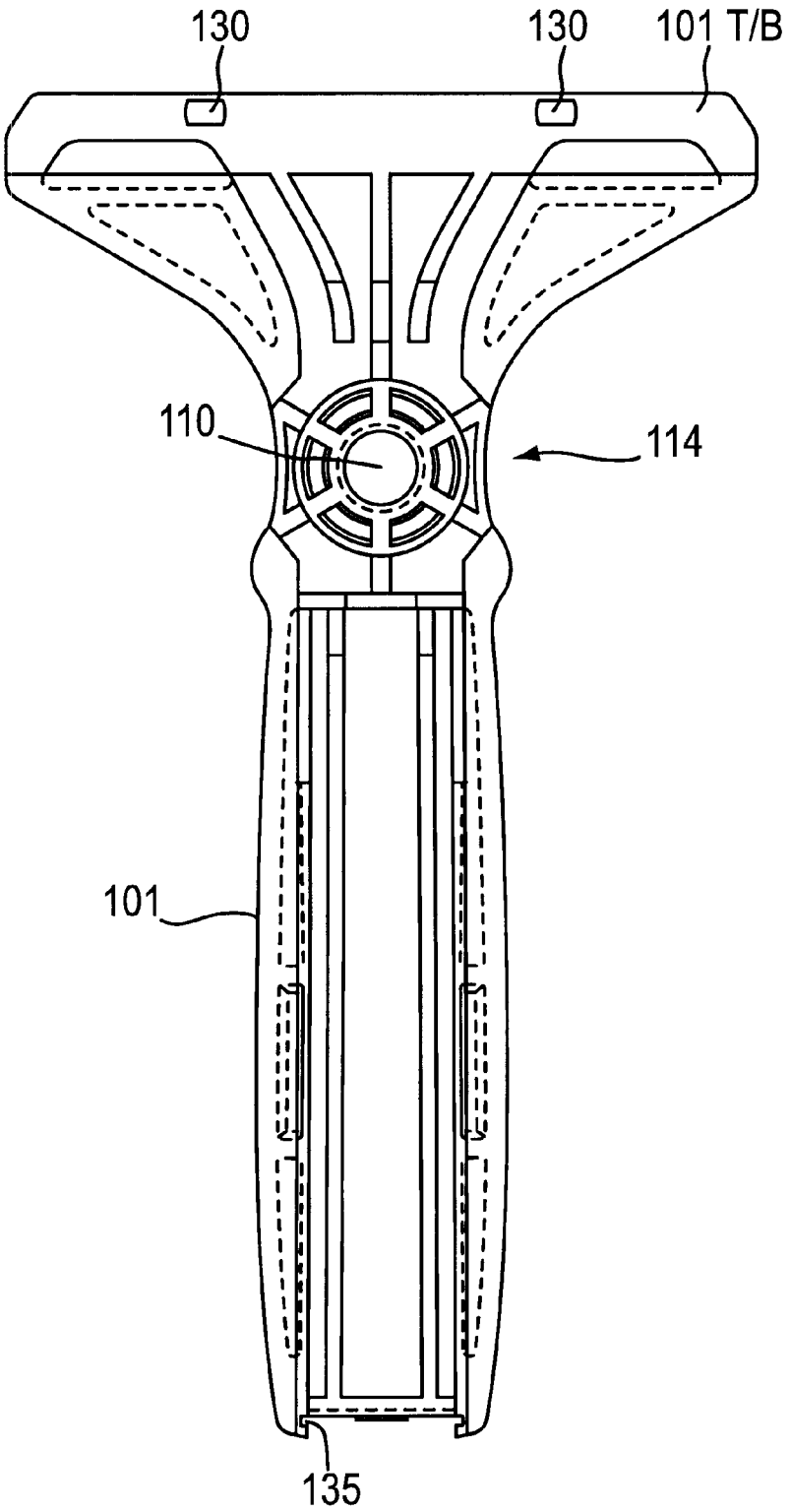
FIG. 3 is a top plan view of a base member of the embodiment of the invention.
Figure 4:
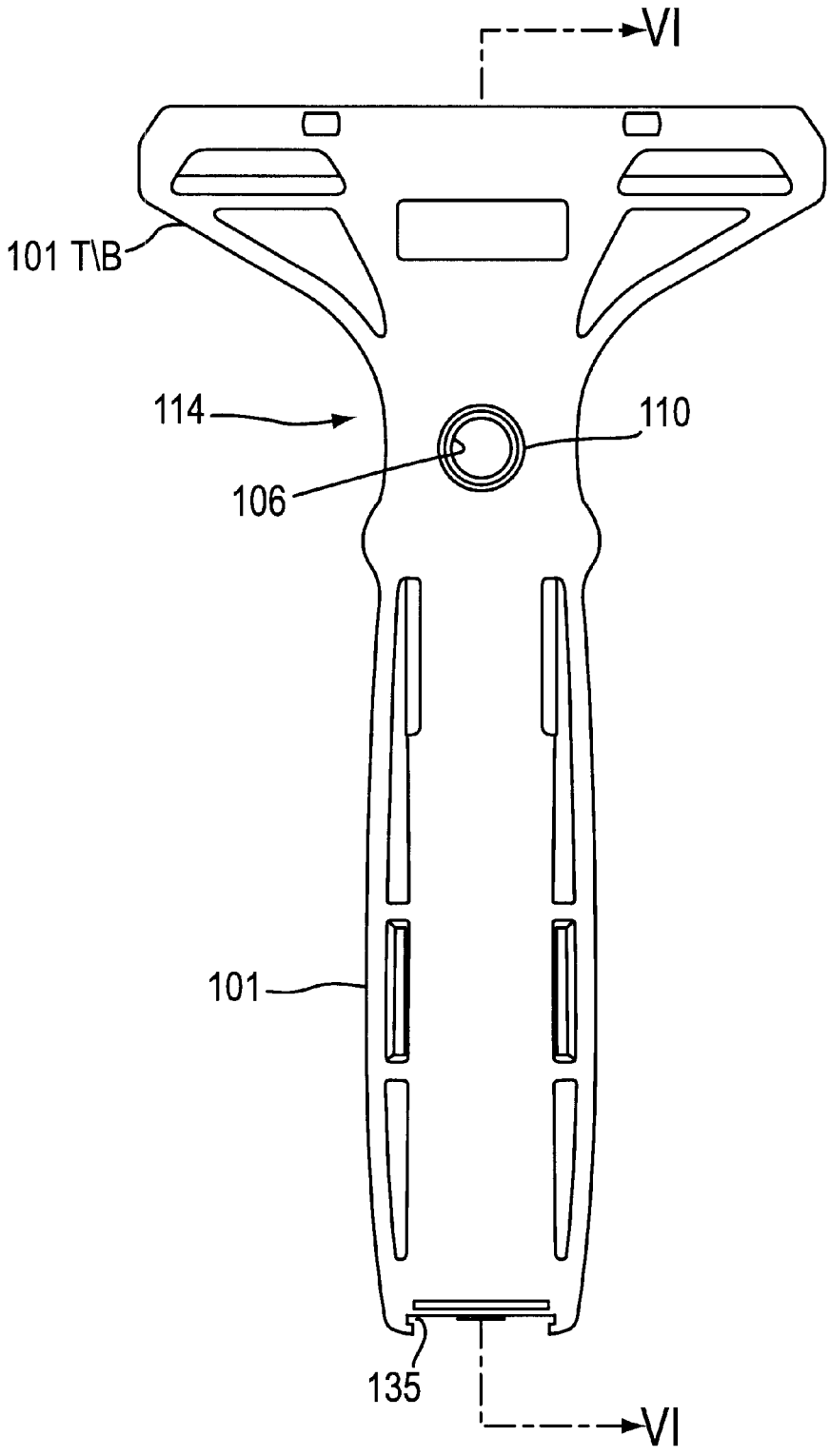
FIG. 4 is a lower plan view of the base portion.
Figure 5:
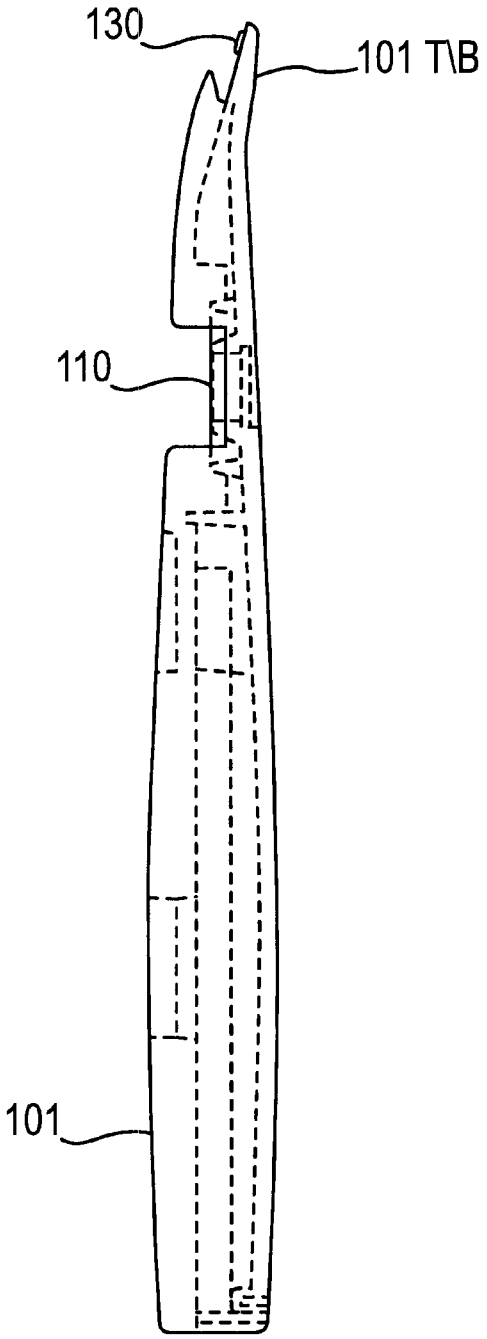
FIG. 5 is side view of the base member.
Figure 6:
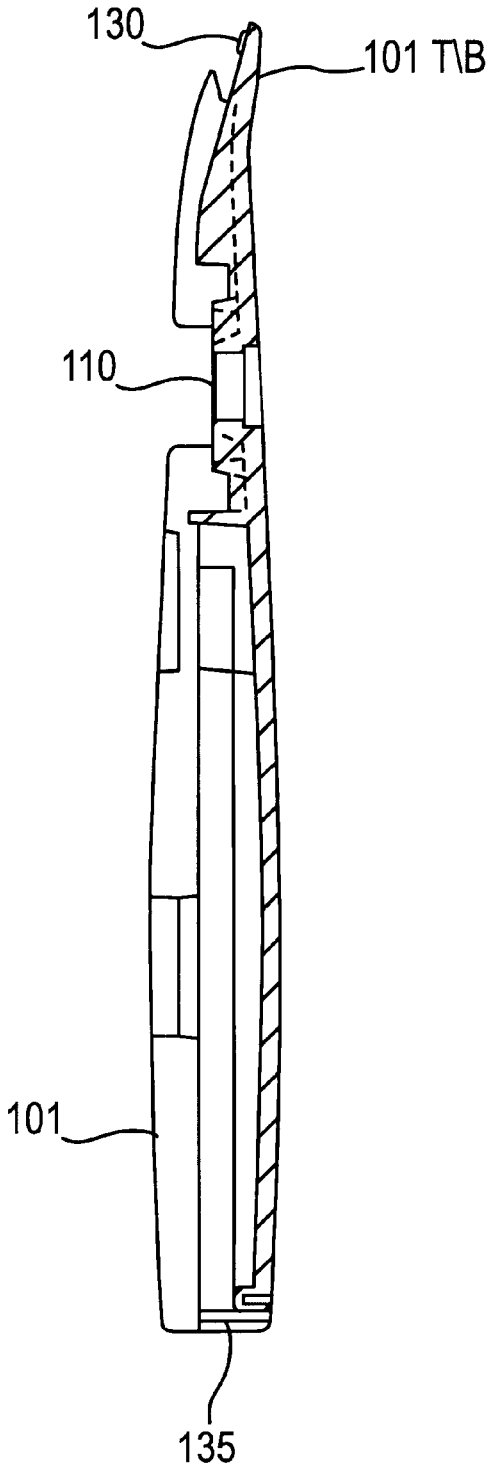
FIG. 6 is a sectional view of the base member taken along section line VI—VI of FIG. 4.
Figure 16:
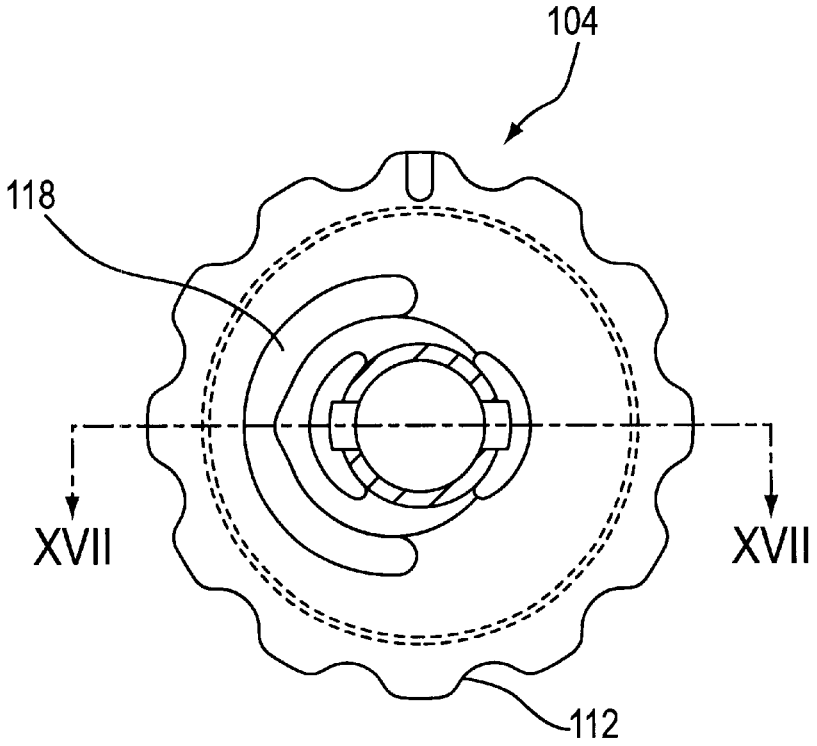
FIG. 16 is a top view of a cam wheel which is mounted on the base and which is used to induce relative displacement between the base and the cover.
Figure 17:
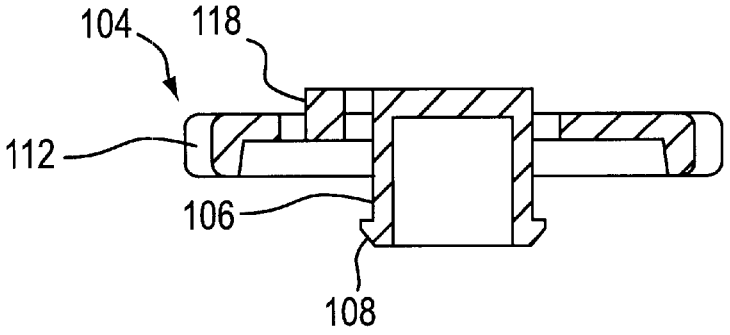
FIG. 17 is a sectional view taken along section line XVII—XVII of FIG. 16.
Figure 18:
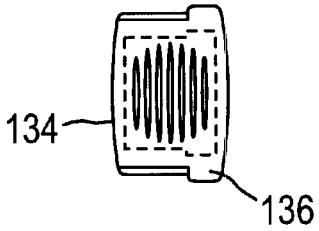
FIGS. 18–22 are views showing details of an end cap which disposed at a rear end of the handle and which is used to close of the interior of the scraper.
Figure 19:
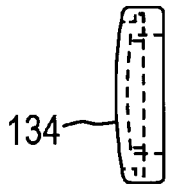
Figure 21A:
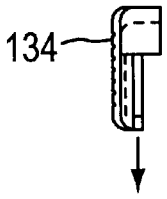
Figure 21B:
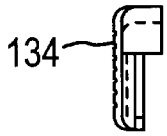
Figure 20:
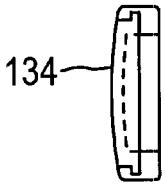
Figure 22:
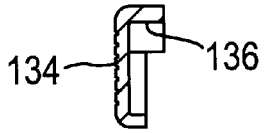

In this embodiment, the mechanism which induces the relative displacement between the base 101 and the cover 102, is a cam wheel 104 which is rotatably supported on the base 101. Details of this cam wheel 104 are shown in FIGS. 16 and 17. As will be appreciated from FIG. 17, the wheel 104 is formed with a shaft 106 which is provided with a barb-like retention flange 108 at its lower edge. This shaft 106 is adapted to be disposed in an opening 110 which, as shown in FIGS. 2–3 is formed through the base 101 at a location proximate the T-bar head portion. The length of the shaft 106 is selected to be just sufficient to allow the retention flange 108 to project out of the lower end of the opening 110 and allow it to engage the lower outboard surface of the base 101. This arrangement, of course, prevents the cam wheel 104 from separating from the base 101 while allowing the wheel 104 to be rotatable with respect to the base 101.

Figure 12:
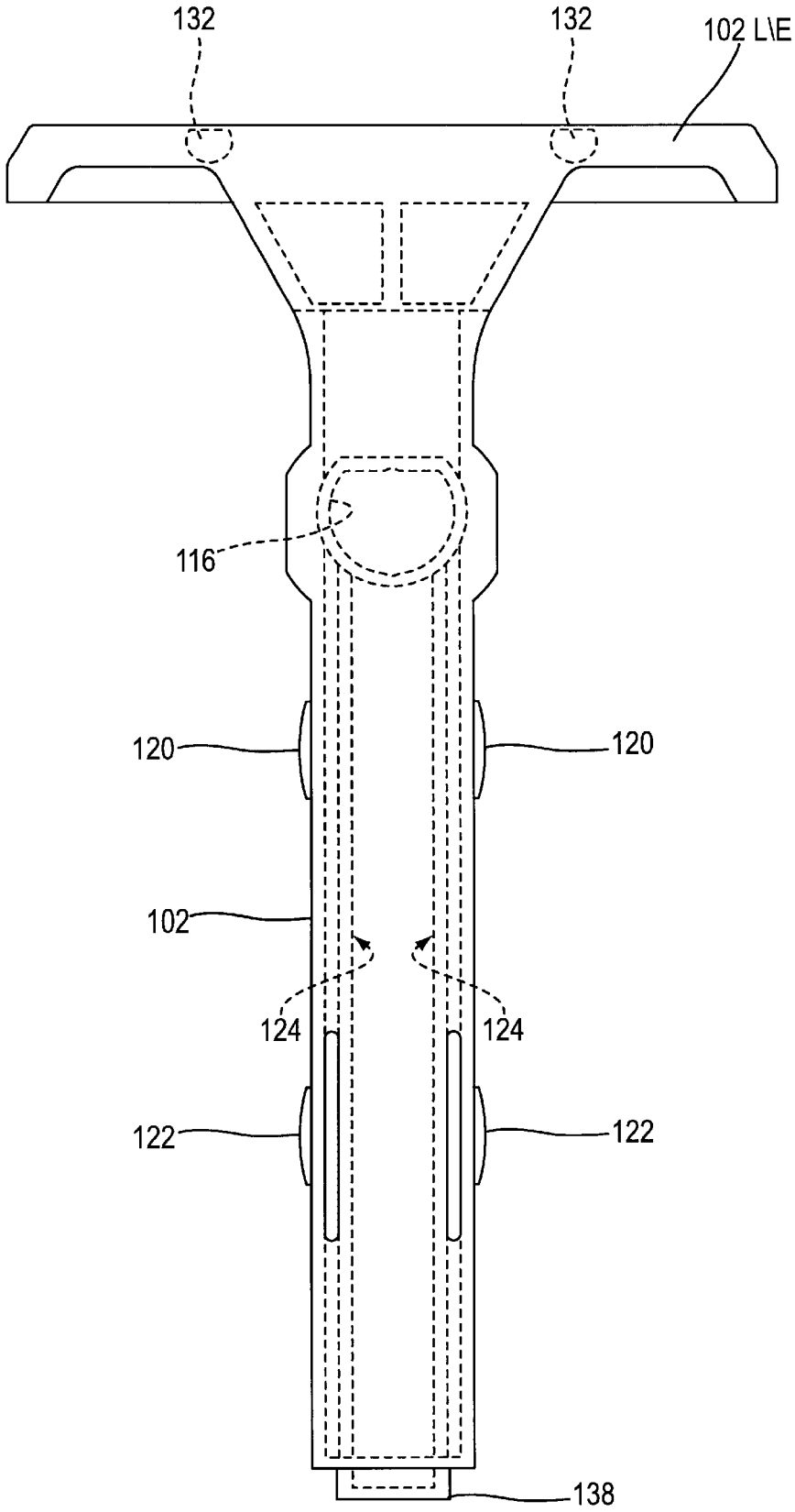
FIG. 12 is a top plan view of a cover member which is adapted to be reciprocatively disposed on the base.

The periphery 112 of the wheel 104 is crenellated to facilitate the rotation thereof using the thumb and/or forefinger of the hand which is holding the scraper 100 and is arranged to, in combination with a waisted portion 114 of the handle, partially project out on either side of the assembled scraper 100 in the manner shown in FIGS. 1 and 2, The cover 102 is formed with a cam follower feature 116 which, as best seen in FIG. 12 has an essentially "D" shape wall structure. This cam follower feature 116 is arranged to enclose the upper portion of the cam wheel 104 on which a cam surface 118 is formed. In this instance the cam surface 118 has an arcuate configuration and is, in this instance, also such as to have a "D" shaped configuration. Rotation of the cam wheel 104 brings the cam surface 118 in engagement with the flat face portion of the cam follower structure 116 and is such as to force the cover 102 to move relative to the base 101 under such conditions.

Figure 14:
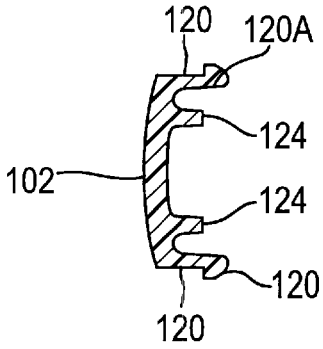
FIGS. 14 and 15 are sectional view respectively taken along section lines XIV—XIV and XV—XV of FIG. 13.
Figure 15:
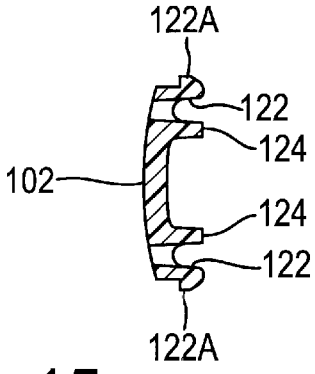
Figure 13:
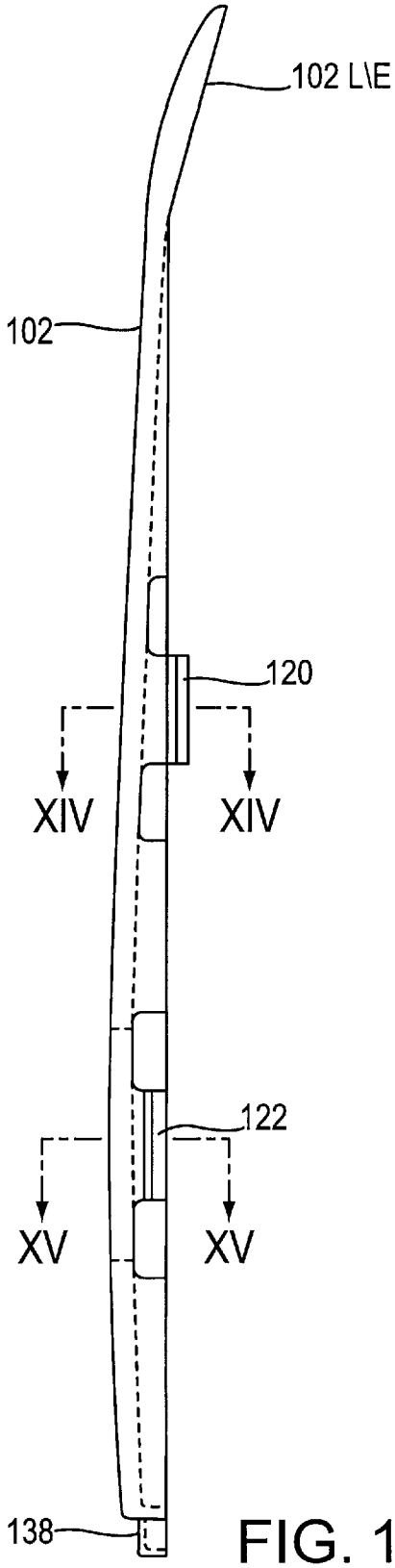
FIG. 13 is a side elevation of the cover.

In order to ensure that the cover 102 is retained on and slides smoothly over the top portion of the base 101, the cover 102 is formed with two sets of engagement flanges 120, 122 which are, as best seen in FIGS. 14 and 15, provided with outwardly extending barb-like engagement lips 120A, 122A. The length of the forward set of engagement flanges 120 are longer than those 122 at the rear.

These engagement flanges 120, 122 are formed on either side of the rib-rail arrangements 124 which extend along the length of the handle portion of the cover 102. The forward ends of the rib-rails merge with the outer wall of the cam follower feature 116.

Figure 7:
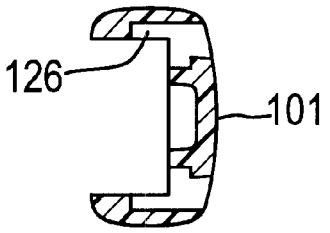
FIGS. 7–10 are sections taken along various points of the handle portion of the base member.
Figure 8:
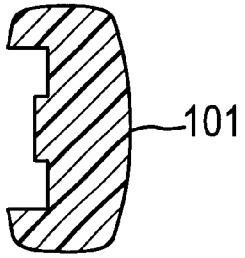
Figure 9:
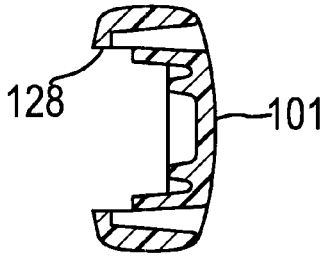
Figure 10:
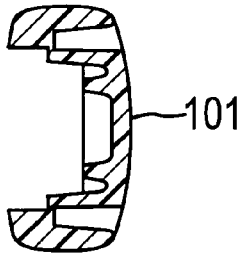
Figure 11:
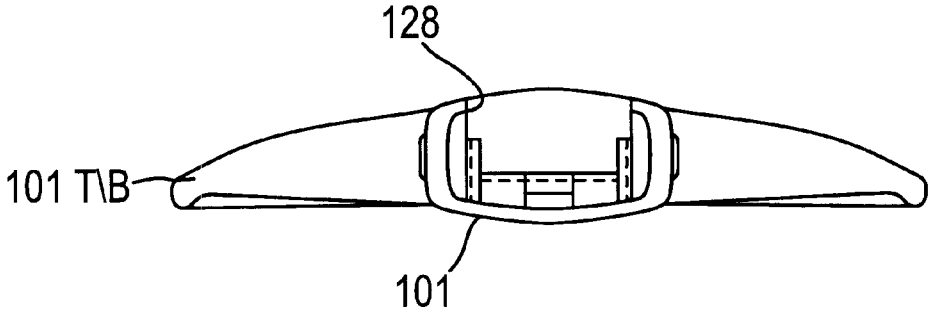
FIG. 11 is an end view of the handle showing the hollow which permits blades to be stored therein and the end portion of the base member which receives an end cap.

The base 101 is formed with a recess structure 126 in the manner depicted on FIG. 7 into which the barbed engagement flanges 120 are engageable and, as best seen in FIGS. 9 and 11, further formed inwardly curved lip portions 128 along the top of the handle portion which are arranged to engage the sides of the cover 102 and to define an undercut space into which the barbed engagement flanges 122 can engage and secure the cover 102 onto the base 101.

This arrangement allows the cover 102 to be snap fitted into place in the opening which is formed along the top of the base 101 and to assume the condition illustrated in FIG. 1. The lengths of the channel-like spaces in which the forward and aft connection flanges 120, 122 are received, can be limited in order to, in addition to the cam wheel/cam follower arrangement, limit the amount of displacement that the cover 102 can undergo with respect to the base 101, if so desired.

The forward T-bar-shaped portion 101T/B of the base 101 is formed with two blade supporting features 130. The leading end of the cover 102 is formed with a pair of recess 132 into which the supporting features 130 can project after passing through openings formed in the blade, and thus lock the blade in position. The size of the recesses 132 is of course, larger than the support features 130 so as to permit the necessary relative movement between the cover 102 and the base 101.

The handle portion of the base is, once the cover 102 is pressed into place on the base 101, such as to be hollow and dimensioned so that spare blades can be stored therein. In order to facilitate access to and closure of this space, an end cap 134 of the nature illustrated in FIGS. 18–21B is used. This cap 134 is adapted to be slid into place in the manner illustrated in FIG. 1, using a guide slot arrangement 135 such as that shown in FIG. 3. The cap 134 is mounted on the base and is provided with an overhead extension portion 136 adapted to provide a space into which a tab-like member 138 at the end of the cover 102 can slide back and forth in as the cover 102 is moved with respect to the base 101 without the hollow interior being physically placed in direct communication with the ambient exterior. A suitable amount of interference between a portion of the cap and the end of the base 101 is provided to keep the cap in place during use of the scraper.

It will be understood that while the present invention has been described with reference to only one specific embodiment, given this disclosure and an understanding of the concept on which the invention is based, various variants and modification will be well within the purview of the person skilled in the art of designing tools such as scrapers and the like, and as such the scope of the present invention is limited only by the appended claims.

Merely by way of example, while the cam wheel is illustrated as being arranged horizontally within the scraper handle, it is possible that the wheel be arranged vertically or at an angle. This use of various cam surfaces to produce various degrees of displacement between the two parts of the tool is also within the real of possibility. The application of the cam wheel and cam follower within other suitable types of hand tools is not discounted.

What is claimed is:

1. A cam operated tool comprising:

first and second halves which are slidably mounted on one another;

a cam follower structure formed on the first half; and a cam wheel having a cam surface rotatably mounted on the second half, the cam wheel having a portion which extends beyond the first and second halves so as to be manually manipulable and rotatable so as to enable selective rotation of the cam wheel in a manner which drives the first and second halves to slide relative to one another.

2. A cam operated tool as set forth in claim 1, further comprising male engagement features formed on one of the first and second halves which engage in female engagement slots formed in the other of the first and second halves, and which can slide along the female engagement slots in a manner which permits the one half to slide with respect to the other.

3. A cam operated tool as set forth in claim 1, further comprising a handle which is defined by first and second end portions of the first and second halves, the first and second end portions cooperating to define a hollow handle portion which is capable of storing at least one tool element.

4. A cam operated tool as set forth in claim 3, further comprising:

a head portion which is connected with the hollow handle portion and which is defined by first and second leading portions of the first and second halves; and a blade mounting portion defined by the first and second leading portions of the first and second halves, the first and second leading portions cooperating to define a blade mounting site.

5. A cam operated tool as set forth in claim 4, wherein the head portion is wider than the hollow handle portion and so dimensioned as to extend out on either side of the handle portion in a manner which forms an essentially T-shape, the first and second leading portions being adapted to support a blade between leading edges of the first and second leading portions.

6. A cam operated tool as set forth in claim 1, further comprising:

a razor blade attached to the second half.

7. A scraper comprising:

a lower body having a handle portion;

an upper cover slidably supported on the body;

a rotatable member operatively supported on one of the body and the cover and which is arranged to interconnect the body and the cover in a manner wherein rotation of the rotatable member causes sliding displacement to occur between the body and the cover.

8. A scraper as set forth in claim 1, further comprising an end cap which is disposed on the end of the handle portion and adapted to enclose an end portion of the cover.

9. A scraper as set forth in claim 8, wherein the handle portion and the cover are arranged to define a hollow portion therebetween in which at least one blade which is mountable at the front of the scraper, can be stored, the cap being slidably mounted on the handle portion so as to be selectively removable from the hand portion in a manner which exposes the hollow portion and permits the removal or insertion of a blade thereinto.

10. A scraper as set forth in claim 7, wherein the rotatable member is mounted on the body and is formed with a cam surface which operatively engages a cam follower structure formed on the inner surface of the cover.

11. A scraper as set forth in claim 7, wherein the rotatable member is mounted on the cover and is formed with a cam surface which operatively engages a cam follower structure formed on the inner surface of the body.

12. A scraper as set forth in claim 7, further comprising:

a razor blade attached to the body.

13. A scraper comprising:

a lower body having a handle portion;

an upper cover slidably supported on the body; and an end cap that is disposed on an end of the handle portion and adapted to enclose an end portion of the cover.

14. A scraper as set forth in claim 13, further comprising:

a storage compartment defined between the handle portion and the cover that is accessed by removal of the end cap.

15. A scraper as set forth in claim 14, further comprising:

a razor blade attached to the body.

16. A scraper comprising:

a lower body having a handle portion;

an upper cover slidably supported on the body;

a storage space defined between the handle portion and the cover; and a rotatable member operatively supported on one of the body and cover interconnecting the body and the cover in a manner wherein rotation of the rotatable member causes sliding displacement to occur between the body and the cover.

* * * * *